US005875732A

United States Patent [19]

Chapman et al.

[11] Patent Number: 5,875,732

[45] Date of Patent: Mar. 2, 1999

[54] METHOD FOR PRODUCTION OF BOAT HULLS AND BOAT HULL CONSTRUCTION

[75] Inventors: Richard D. Chapman, Etobicoke; Robert D. Schad, Toronto, both of Canada

[73] Assignee: Husky Airboats, Canada

[21] Appl. No.: 844,379

[22] Filed: Apr. 18, 1997

[51] Int. Cl.[6] ..... B63B 5/24

[52] U.S. Cl. ..... 114/357

[58] Field of Search ..... 114/355, 356, 114/357, 56, 57

[56] References Cited

U.S. PATENT DOCUMENTS 4,120,632 10/1978 Stoeberl .
4,706,597 11/1987 Figone .
4,760,811 8/1988 Hopper .
5,096,651 3/1992 Le Comte .
5,266,249 11/1993 Grimes, II et al. .
5,277,145 1/1994 Hordis .
5,387,390 2/1995 Kornylo .
5,522,340 6/1996 Skogman .
5,601,049 2/1997 Hordis et al. ..... 114/357
5,647,784 7/1997 Moran ..... 114/357

*Primary Examiner*—Stephen Avila
*Attorney, Agent, or Firm*—Bachman & LaPointe, P.C.

[57] ABSTRACT

Boat hulls are prepared by positioning reinforcing material in a mold, applying vacuum to firmly hold the reinforcing material against the mold, positioning a fiberglass-resin mixture over the reinforcing material, placing a vacuum bag over the fiberglass mixture, and evacuating the vacuum bag to press the fiberglass mixture against the reinforcing material to bond the fiberglass mixture to the reinforcing material. Also discloses a boat hull construction.

19 Claims, 4 Drawing Sheets

METHOD FOR PRODUCTION OF BOAT HULLS AND BOAT HULL CONSTRUCTION

BACKGROUND OF THE INVENTION

The present invention forms a reinforced boat hull structure by placing reinforcing materials inside a hull mold and forming same to the hull shape by locally applied vacuum ports. While vacuum continues to be applied a fiberglass matting and resin mixture is applied to the inner surface of the reinforcing material and hull mold, bonding the fiberglass mixture to the reinforcing material by curing, thereby obtaining a reinforced hull structure.

Conventional fiberglass hull construction is obtained by providing a mold, laying fiberglass matting and bonding compound inside the mold to form the exterior shape of the hull, placing a vacuum bag over the mold inner space, evacuating the air inside the mold interior under the bag so as to cause the bag to collapse against the freshly applied fiberglass mixture and thus forcing it against the mold inner surface. The vacuum, hence pressure for hull forming, cannot be applied until the entire fiberglass matting and bonding compound is applied over all the mold form and access to the matting-compound mixture is denied while the vacuum bag is in place and vacuum applied. Installing reinforcing materials or adjusting the matting-compound mixture is not possible while the vacuum is present. Moreover, attaching reinforcing materials, as ultra high molecular weight polyethylene (UHMW) to the exterior surface of the hull is currently accomplished by the use of mechanical fasteners, screws, etc., which are inherently weaker than a fully bonded, laminate construction.

It is a principal objective of the present invention to provide an improved procedure for forming reinforced boat hulls and improved boat hull constructions which conveniently enables one to obtain a fully bonded, laminate construction, and especially to enable one to conveniently attach reinforcing materials to the external surface of the hull while obtaining a fully bonded laminate.

Further objects and advantages of the present invention will be apparent from the following discussion.

SUMMARY OF THE INVENTION

In accordance with the present invention, the foregoing objects and advantages are readily obtained.

In accordance with the present invention, reinforced boat hulls are obtained by: providing a boat hull mold with an inner surface and a mold cavity, wherein said mold cavity has the shape of a boat hull and with multiple vacuum ports communicating with said inner surface; positioning reinforcing material in said mold, with a lower surface thereof facing the inner surface of the mold and an upper surface thereof facing the mold cavity; applying vacuum to said vacuum ports to hold the reinforcing material firmly against the inner surface; positioning a fiberglass-resin mixture in the mold over the reinforcing material upper surface and over the mold inner surface; placing a vacuum bag over the fiberglass mixture; evacuating the vacuum bag to press the fiberglass mixture against the reinforcing material and bonding the fiberglass mixture to the reinforcing material, to form a bonded, reinforced hull structure.

An improved, reinforced boat hull is also provided having: an outer reinforcing material with an inner face; an inner fiberglass-resin mixture bonded to said inner face of said reinforcing material and forming the shape of said boat hull, wherein said reinforcing material is fiber backed polyolefin, preferably ultra high molecular weight (UHMW) polyethylene, with the fiber backing in the form of a woven mesh to provide a bonding site for the fiberglass mixture.

The present invention also provides an improved, reinforced boat hull having: an outer reinforcing material with an inner face; an inner fiberglass-resin mixture bonded to said inner face of said reinforcing material and forming the shape of said boat hull; and at least one layer affixed to the inner face of said reinforcing material to provide an anchor for the fiberglass mixture.

Further features and advantages of the present invention will appear hereinbelow.

BRIEF DESCRIPTION OP THE DRAWINGS

The present invention will be more readily understood from a consideration of the following illustrative drawings, wherein.

Further features of the present invention will appear hereinbelow.

DETAILED DESCRIPTION OF PREFERRED EMBODIMENTS

Figure 1:
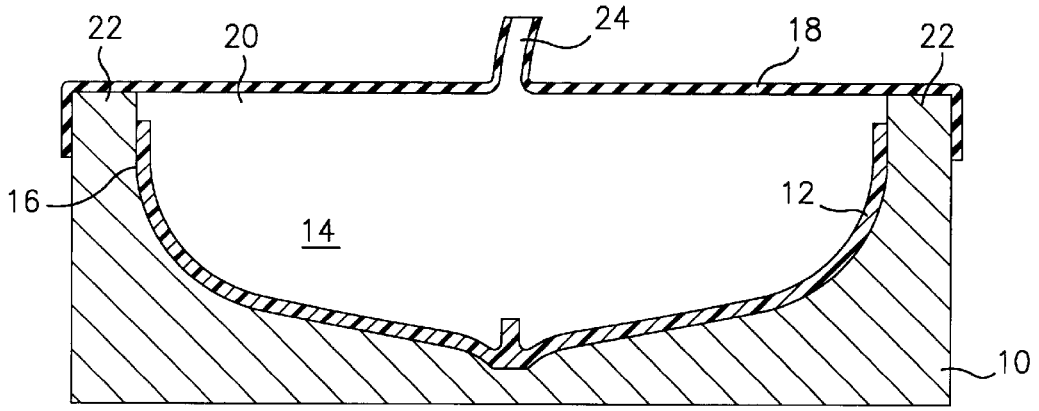
FIG. 1 (PRIOR ART)
FIG. 1 is a cross-sectional view of a conventional hull mold with fiberglass-resin mixture and vacuum bag.
Figure 2:
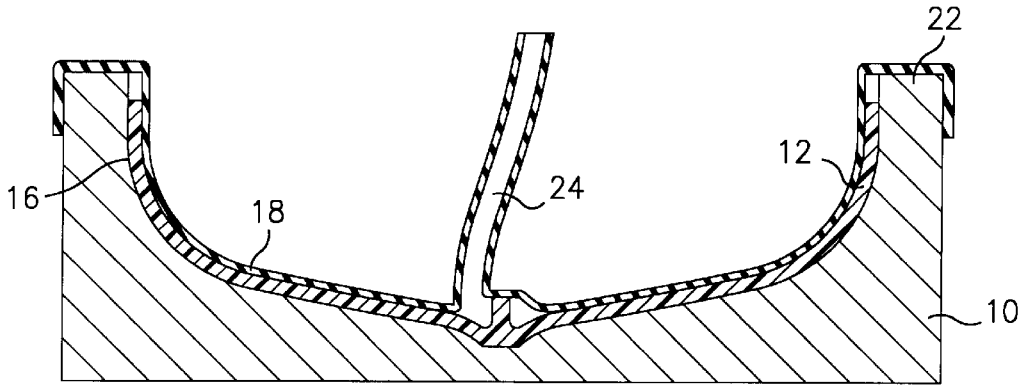
FIG. 2 (PRIOR ART)
FIG. 2 is a cross-sectional view of the mold of FIG. 1 with the fiberglass mixture and vacuum bag evacuated.

FIG. 1 shows, schematically, a conventional boat hull mold 10 with a fiberglass matting-resin mixture 12 laid up inside mold cavity 14 against the inner surface 16 thereof. The mold cavity inner surface 16 has the desired shape of a boat hull. A vacuum bag 18, which may be any desired flexible material as rubber, is stretched over open side 20 of mold cavity 14 and fastened to mold edges 22, as by using double-sided masking tape. Hose 24, connected on the downstream side to vacuum bag 18 is connected on the upstream side to a vacuum source (not shown). FIG. 2 shows the effect of evacuating the air trapped under the vacuum bag inside mold cavity 14. The vacuum bag 18 is forced against the fiberglass mixture 12 compressing said mixture against mold inside surface 16 and thereby forming the desired hull shape. After curing of the resin and solidifying the fiberglass-resin mixture, the vacuum is released and the vacuum bag removed leaving the formed boat hull.

Figure 3:
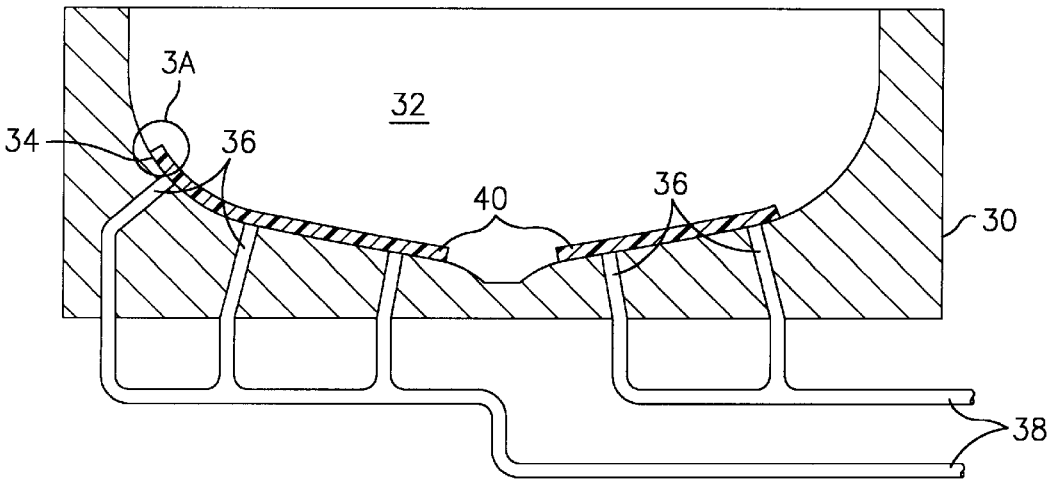
FIG. 3 is a cross-sectional view of the present invention with reinforcing material in place.
Figure 3A:
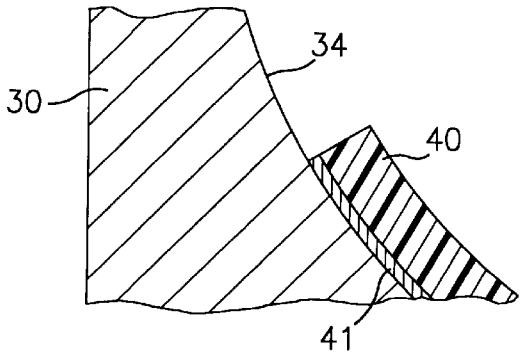
FIG. 3A is a partial, enlarged sectional view of area 3A in FIG. 3.
Figure 4:
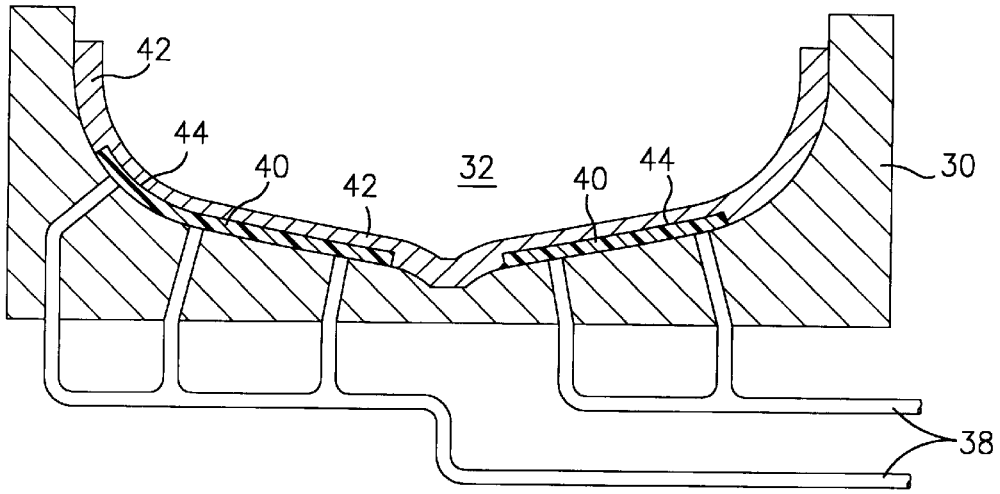
FIG. 4 is a view similar to FIG. 3 with fiberglass mixture in place.
Figure 5:
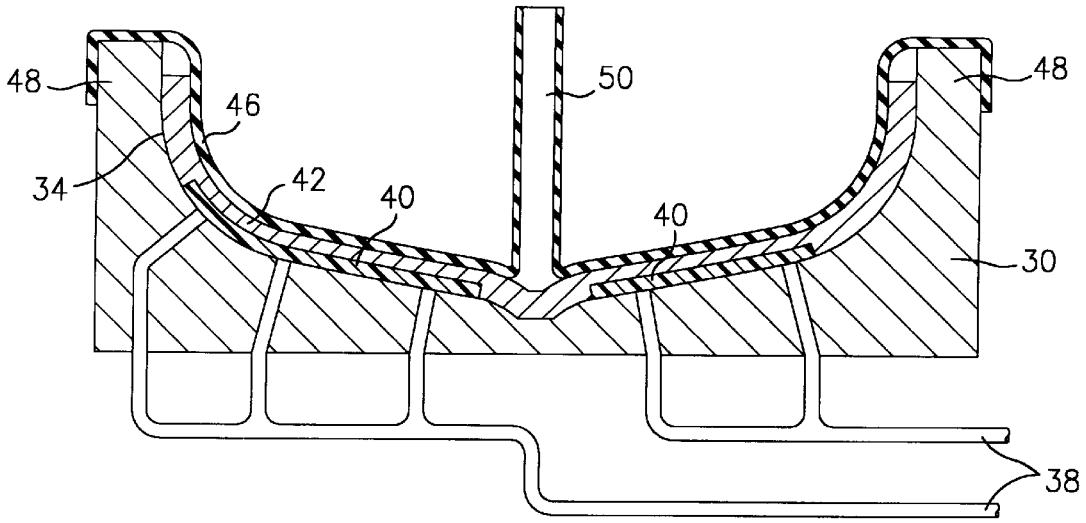
FIG. 5 is a view similar to FIG. 4 with a vacuum bag evacuated.

In accordance with the present invention, as shown in FIGS. 3–5, a modified hull mold 30 is shown having a mold cavity 32 and a mold inner surface 34 in the shape of the desired hull structure, with reinforcing materials 40 held against surface 34 by holding means, as double-sided masking tape 41 as shown in FIG. 3A. Multiple vacuum ports 36 are arranged around the hull mold inner surface at locations where reinforcing materials are desired to be located. Vacuum ports 36 are connected via hoses 38 to one or more vacuum sources (not shown) such that when vacuum is applied the reinforcing materials 40 positioned on mold inner surface 34 are held firmly against mold inner surface 34 as shown in FIG. 3, and in the case of flexible reinforcing materials are bent to conform to the mold inner surface. The exact number of vacuum ports is not especially critical, except that they should be sufficient to firmly hold the reinforcing material against the mold inner surface. Vacuum can be applied selectively to permit adjustment of materials at the selected sites, and vacuum is applied continuously to maintain the reinforcing materials firmly against the mold inner surface during application of the fiberglass matting-resin mixture 42 to the reinforcing material upper surface 44 and to the mold inner surface 34 as shown in FIG. 4. Thus, personnel have access to the inside of mold 32 while vacuum is applied externally to the mold to firmly hold the reinforcing material against the mold inner surface during placement of the fiberglass mixture and during adjustment of same.

Next, the vacuum bag 46 is fastened to mold edges 48 in a manner after FIGS. 1–2 and evacuated via hose 50 also in a manner after FIGS. 1–2, to press the fiberglass mixture 42 against the hull mold inner surface 34 and reinforcing material 40, at the same time maintaining vacuum via vacuum ports 36 to assure conformance of the reinforcing material to the mold inner surface. After curing the vacuum is released from the vacuum bag and from the vacuum ports and the composite hull is removed from the mold. The fiber reinforced plastic is readily cured and with some resins may be cured at room temperature, but some may require elevated temperature.

A wide variety of reinforcing materials may be used, as polyolefins such as polyethylene or polypropylene; however, desirably the reinforcing material is fiber backed ultra high molecular weight (UHMW) polyethylene. The preferred fiber is a graphite or aramid fiber, such as KEVLAR, a trademark of the DuPont company for aramid fibers. Desirably, the aramid fiber backing is in the form of a woven matting with the woven portion facing the mold cavity, which provides excellent sites for the fiberglass matting-resin mixture to form a bond.

The fiberglass-resin mixture may use a variety of resins, preferably vinylester or epoxy resins, and desirably a resin with room temperature curing characteristics. A glass to resin weight ratio of 20–80 to 60–40 is employed, although higher glass to resin ratios may be used.

Figure 6:
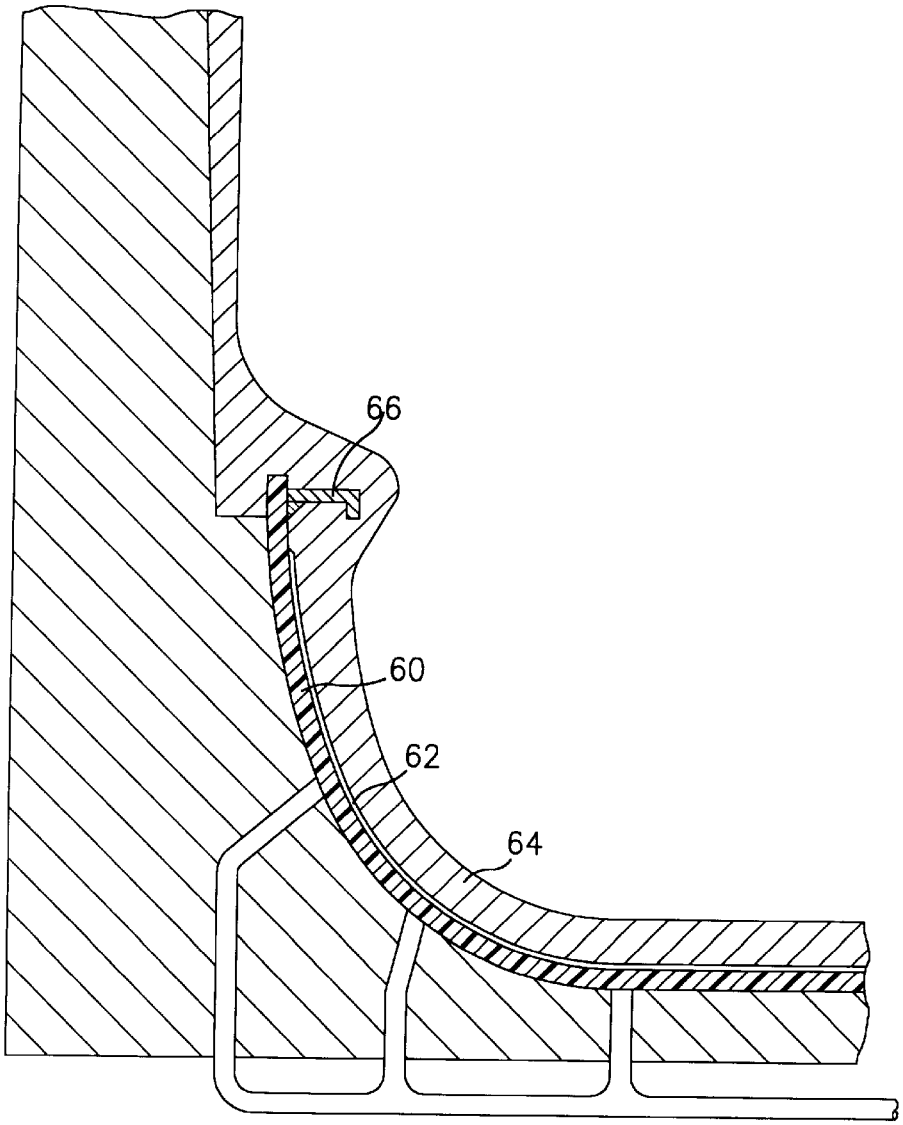
FIGS. 6–7 are partial cross-sectional views of modified mold-hull constructions of the present invention.

A modification of the present invention is shown in FIG. 6 which shows reinforcing material comprising UHMW polyethylene 60 with woven KEVLAR backing 62 and with the fiberglass-resin mixture 64 adhered as in FIGS. 3–5. In accordance with FIG. 6, one or more flanges or hooks 66 are affixed to the inner surface of the reinforcing material as by welding so as to form an anchor or mechanical interlock with the applied fiberglass-resin mixture. The KEVLAR backing is removed locally from the welding site or sites. Otherwise, the procedure is as shown in FIGS. 3–5.

Figure 7A:
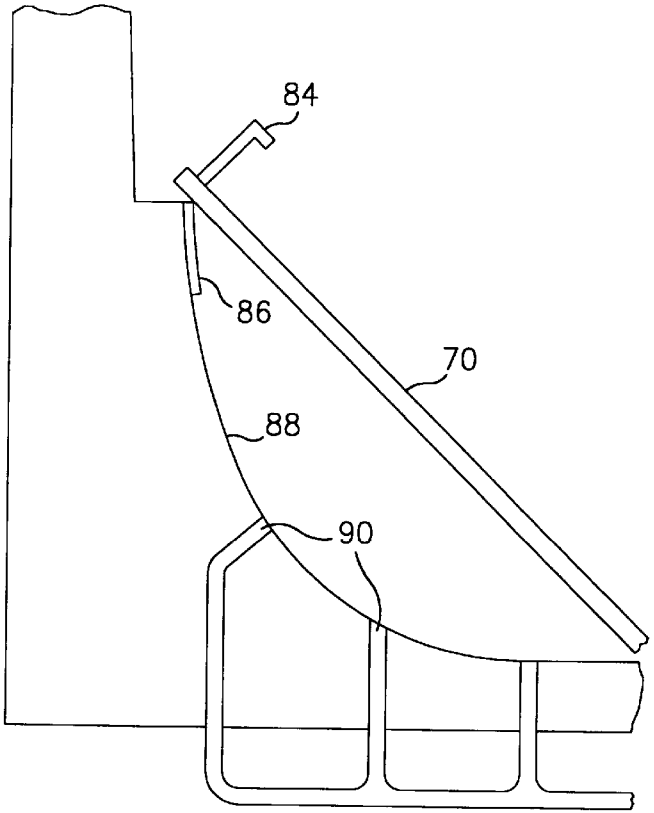
FIG. 7A is a view similar to FIG. 7 in an earlier stage of production.
Figure 7:
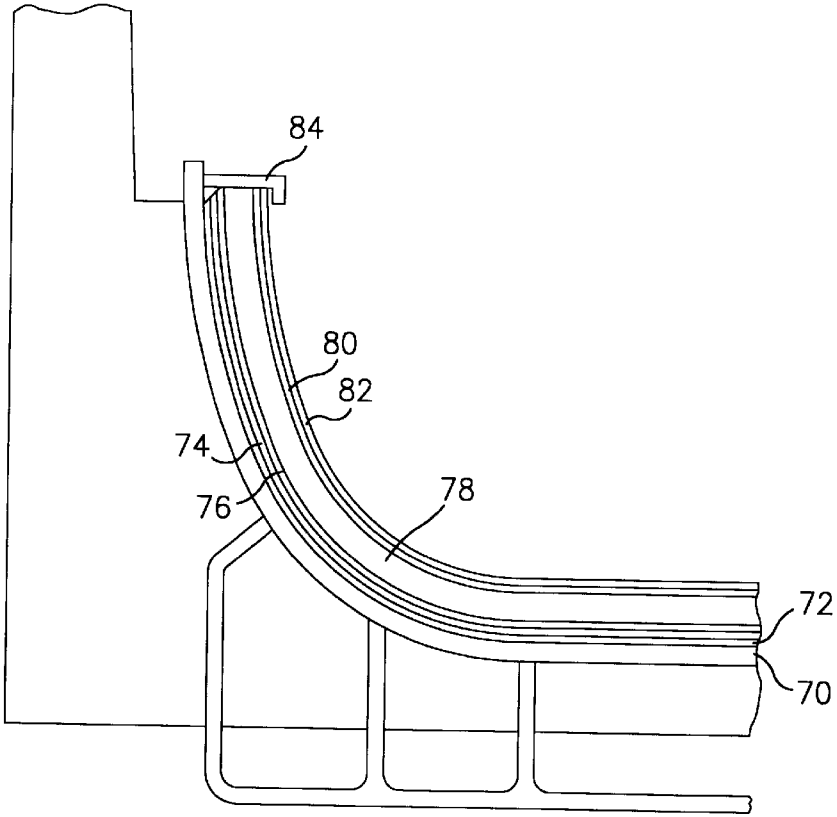

A further modified structure, prepared in accordance with the procedure of FIGS. 3–5, is shown in FIG. 7 which shows outer layer of UHMW polyethylene 70 with KEVLAR woven mesh backing 72, two further layers of bonded KEVLAR 74, 76, an inner layer of fiberglass-resin mixture 78 and two further innermost layers of KEVLAR 80, 82 bonded to the fiberglass-resin mixture. At least one hook or flange 84 is welded to the UHMW polyethylene to serve as an anchor for the applied layers.

In a preferred embodiment shown in FIGS. 7 and 7A, double-sided adhesive tape 86 is affixed to mold inner surface 88 where one edge of the UHMW material 70 will be located. The UHMW material 70 is laid in the mold aligning said material to the tape 86 as shown in FIG. 7A. Note that the UHMW material 70 is stiff and does not conform to the mold shape, nor does it necessarily adhere to tape 86 at this stage. A vacuum bag is then stretched over the mold and vacuum applied as shown in FIGS. 2 and 5. This forces the UHMW material to conform to mold inner surface 88, with tape 86 gripping the UHMW material 70 and helping to maintain material 70 in position as it deflects to the position shown in FIG. 7. While still applying vacuum via the vacuum bag, a second vacuum source is applied to ports 90 so as to maintain the UHMW material in place when the vacuum from the vacuum bag is removed. After removal of the vacuum from the vacuum bag and after removal of the vacuum bag, the inner surface 88 of the mold and the UHMW material are exposed and accessible for applying the layup material as well as other layers in a conventional fashion. The second vacuum via ports 90 is maintained during the layup process and during curing.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A method for the production of reinforced boat hulls, which comprises:

providing a boat hull mold with an inner surface and a mold cavity, wherein said mold cavity has the shape of a boat hull and with multiple vacuum ports communicating with said inner surface;

positioning reinforcing material in said mold with a lower surface thereof facing the inner surface of the mold and with an upper surface thereof facing the mold cavity;

positioning a fiberglass-resin mixture in the mold over said reinforcing material upper surface and over the mold inner surface;

placing a vacuum bag over said fiberglass mixture; and evacuating the vacuum bag to press the fiberglass mixture against the reinforcing material, applying vacuum to said vacuum ports to hold the reinforcing material firmly against said inner surface, and bonding the fiberglass mixture to the reinforcing material, including the step of affixing a flange to the reinforcing material to provide an anchor for the fiberglass mixture, thereby forming a bonded, reinforced hull structure.

2. A method according to claim 1, wherein said reinforcing material is fiber backed, ultra high molecular weight polyethylene.

3. A method according to claim 2, wherein said fiber is an aramid fiber.

4. A method according to claim 2, wherein said fiber is in the form of a woven mesh backing.

5. A method according to claim 1, wherein the glass to resin weight ratio is 20–80 to 60–40.

6. A method according to claim 1, wherein the resin is polyester resin.

7. A method according to claim 1, including the step of continuously applying vacuum to said vacuum ports while positioning the fiberglass mixture and while bonding the fiberglass mixture to the reinforcing material.

8. A method according to claim 1, wherein said reinforcing material is held in place in said mold at least in part by holding means.

9. A method according to claim 1, wherein said reinforcing material comprises reinforcing panels.

10. A method according to claim 1, including the step of applying a first vacuum via said vacuum bag to force the reinforcing material to conform to the mold cavity.

11. A method according to claim 10, including the step of applying a second vacuum via said vacuum ports to hold the reinforcing material against said inner surface.

12. A method for the production of reinforced boat hulls, which comprises:

providing a boat hull mold with an inner surface and a mold cavity, wherein said mold cavity has the shape of a boat hull and with multiple vacuum ports communicating with said inner surface;

positioning reinforcing material in said mold with a lower surface thereof facing the inner surface of the mold and with an upper surface thereof facing the mold cavity wherein said reinforcing material is held in place in at least in part by holding means and wherein said holding means is double-sided tape affixed on one side to the inner surface of the mold and on the other side to the reinforcing material;

positioning a fiberglass-resin mixture in the mold over said reinforcing material upper surface and over the mold inner surface;

placing a vacuum bag over said fiberglass mixture; and evacuating the vacuum bag to press the fiberglass mixture against the reinforcing material, applying vacuum to said vacuum ports to hold the reinforcing material firmly against said inner surface, and bonding the fiberglass mixture to the reinforcing material, thereby forming a bonded, reinforced hull structure.

13. A method for the production of reinforced boat hulls, which comprises:

providing a boat hull mold with an inner surface and a mold cavity, wherein said mold cavity has the shape of a boat hull and with multiple vacuum ports communicating with said inner surface;

positioning reinforcing material in said mold with a lower surface thereof facing the inner surface of the mold and with an upper surface thereof facing the mold cavity;

positioning a fiberglass-resin mixture in the mold over said reinforcing material upper surface and over the mold inner surface;

placing a vacuum bag over said fiberglass mixture; and evacuating the vacuum bag to press the fiberglass mixture against the reinforcing material, applying vacuum to said vacuum ports to hold the reinforcing material firmly against said inner surface, and bonding the fiberglass mixture to the reinforcing material, including the steps of applying a first vacuum via said vacuum bag to force the reinforcing material to conform to the mold cavity, applying a second vacuum via said vacuum ports to hold the reinforcing material against said inner surface, and maintaining vacuum from the vacuum ports while the vacuum bag is removed and applying the fiberglass-resin mixture to the reinforcing material while the vacuum from the vacuum ports continues to hold the panels against the inner surface, thereby forming a bonded, reinforced hull structure.

14. A method according to claim 13, including the step of positioning the vacuum bag over the fiberglass-resin mixture and applying the first vacuum again to compress the fiberglass-resin mixture against the reinforcing material until the fiberglass-resin mixture is cured.

15. A reinforced boat hull, which comprises: an outer reinforcing material having an inner face; an inner fiberglass-resin mixture bonded to the inner face of the reinforcing material and forming the shape of a boat hull; and at least one flange affixed to the inner face of said reinforcing material to provide an anchor for the fiberglass mixture.

16. A hull according to claim 15, wherein said reinforcing material is fiber backed, ultra high molecular weight polyethylene.

17. A hull according to claim 15, wherein said fiber is an aramid fiber.

18. A hull according to claim 15, wherein said fiber is in the form of a woven mesh backing.

19. A hull according to claim 15, wherein the resin is polyester resin.

* * * * *